United States Patent [19]

Imaizumi

[11] Patent Number: 4,473,314

[45] Date of Patent: Sep. 25, 1984

[54] PRINTING APPARATUS RESPONSIVE TO PAPER FEEDING DEVICE POSITION

[76] Inventor: Mamoru Imaizumi, c/o Brother Kogyo Kabushiki Kaisha, 35, 9-chome, Horita-dori, Mizuho-ku, Nagoya-shi, Aichi-ken, Japan

[21] Appl. No.: 463,324

[22] Filed: Feb. 2, 1983

[51] Int. Cl.[3] ..... B41J 11/58; B41J 13/10

[52] U.S. Cl. ..... 400/625; 271/3; 400/279; 400/629

[58] Field of Search ..... 400/61, 64, 279, 624, 400/625, 629, 342; 271/3, 4, 256, 257

[56] References Cited

U.S. PATENT DOCUMENTS

| | | | |
|---|---|---|---|
| 4,222,557 | 9/1980 | Wu | 400/629 X |
| 4,326,815 | 4/1982 | Kapp | 400/629 X |
| 4,371,276 | 2/1983 | Mitrovich et al. | 400/629 X |
| 4,388,008 | 6/1983 | Greene et al. | 400/625 X |
| 4,391,542 | 7/1983 | Baitz | 400/624 X |
| 4,407,597 | 10/1983 | Kapp | 400/625 |

FOREIGN PATENT DOCUMENTS

| | | | |
|---|---|---|---|
| 42673 | 4/1981 | Japan | 400/629 |
| 210877 | 12/1982 | Japan | 400/629 |

*Primary Examiner*—Paul T. Sewell

[57] ABSTRACT

A printing apparatus having a printing assembly and a paper handling assembly including a paper feeding device for feeding sheets of paper of one kind from a first paper stacker along a first path and further including a paper advancing device selectively advancing to the printing assembly either the sheets of paper of the one kind or sheets of paper of another kind fed along a second path. The apparatus comprises a first memory for storing information representing margin positions and tabulation positions, and other data associated with the sheet of paper of one kind, a second memory for storing similar information associated with the sheet of paper of another kind, a detector for detecting an operative or inoperative position of the paper feeding device and generating a signal representing the detected position, and a control device responsive to the signal from the detector and selecting the first or second memory.

9 Claims, 3 Drawing Figures

PRINTING APPARATUS RESPONSIVE TO PAPER FEEDING DEVICE POSITION

BACKGROUND OF THE INVENTION

The present invention relates to a printing apparatus including a paper feeding device for feeding individual sheets of paper one after another from a storage stacker along a first path, and further including a paper advancing device for selectively advancing to a printing assembly the sheets of paper fed along the first path or a sheet of paper of another kind fed along a second path.

In the art of a printing apparatus having a paper storage/feeder unit for storing a stack of paper on a storage tray or stacker thereof and delivering the individual sheets of paper one after another to a printing assembly of the apparatus, there has been a requirement for a so-called "interruption printing" which is performed during interruption of an ordinary printing operation on the successive sheets of paper delivered from the storage tray. Such interruption printing is effected on a sheet or sheets of paper different in size and/or format from the sheets stored in the paper storage tray. In this interruption printing, the previously established settings of right and left margin positions and tabulation positions for the ordinary printing mode must be changed to meet the specific requirement of the different sheets of paper used in the interruption printing mode. This change in the margin and tabulation settings requires subsequent re-establishment of the original settings for the ordinary printing mode of operation after the interruption printing has been completed. Thus, the printing apparatus having the paper storage/feeder unit known in the art has a problem of low printing efficiency due to requirement for considerable time and efforts to make a changeover from the ordinary printing mode to the interruption printing mode discussed above.

SUMMARY OF THE INVENTION

It is accordingly an object of this invention to provide a printing apparatus capable of printing selectively on two different kinds of paper according to specific printing requirements depending upon the kind of paper used, with easy and fast changeover between the two modes of printing on such different kinds of paper.

Another object of the invention is to provide a printing apparatus having a paper handling assembly including a paper storage stacker, which apparatus uses a first data memory for storing information associated with one kind of paper sheets which are delivered from the storage stacker, and a second data memory for storing information associated with another kind of paper sheets different from said one kind, the first and second data memories being selected with easy and fast setting of the paper handling assembly.

According to the present invention, there is provided a printing apparatus having a printing assembly including a paper feeding device having a paper stacker and feeding individual sheets of paper of one kind one after another from the paper stacker along a first path, and further including a paper advancing device selectively advancing to the printing assembly either the sheets of paper of said one kind fed along the first path, or sheets of paper of another kind fed along a second path when the paper feeding device is inoperative, the printing apparatus comprising:

a first read/write memory for storing a first set of information associated with the sheets of paper of said one kind;

a second read/write memory for storing a second set of information associated with the sheets of paper of said another kind;

detection means for detecting an operative or inoperative position of the paper feeding device, the detection means generating an electric detection signal representing the detected position; and a control device connected to the first and second memories and the detection means, and responsive to the detection signal, said control device selecting, as an effective memory, the first read/write memory when the paper feeding and advancing device is set in the operative position and the second read/write memory when the same device is set in the inoperative position.

In a preferred form of the printing apparatus of the invention, the paper handling assembly further includes another paper stacker pivotable selectively between a first position thereof at which it is operative to receive the printed sheets of paper of said one kind, and a second position thereof at which the sheets of paper of said another kind can be advanced by the paper advancing device. In this embodiment, the detection means detects, to detect the operative position of the paper feeding and advancing device, the selected first or second position of said another paper stacker and generates the detection signal representing the detected position of said another paper stacker.

In accordance with the invention, the first and second sets of information stored in the respective first and second read/write memories includes data representing right and left margin positions and tabulation positions of the sheets of papers of the two different kinds.

In the printing apparatus constructed as described above, two modes of printing operations on different kinds of paper sheets can be selectively performed with easy and fast changeover of the paper handling assembly including the paper storage stacker storing a stack of paper sheets of one kind. Each mode of operation is effected according to the appropriate set of information stored in the respective read/write memory, for example, data representing the desired settings of right and left margins and tabulation.

BRIEF DESCRIPTION OF THE DRAWINGS

The above and other objects, features and advantages of the present invention will become more apparent from reading the following description of the preferred embodiment taken in connection with the accompanying drawings in which.

DETAILED DESCRIPTION OF THE PREFERRED EMBODIMENT

Figure 1:
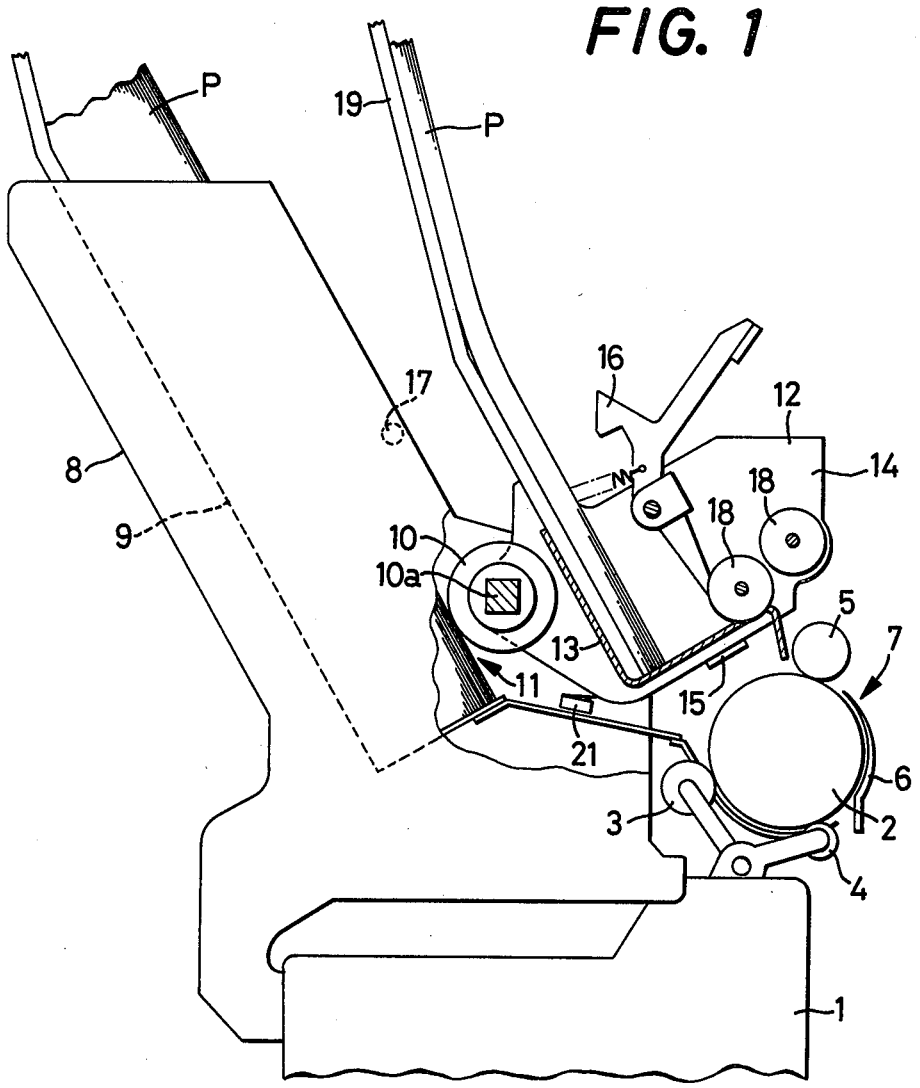
FIG. 1 is a side cross sectional, partially cutaway view of a part of a printing apparatus embodying the present invention, showing a paper handling assembly thereof placed in its first position wherein a sheet of paper of one kind is fed from a paper stacker to a printing section of the apparatus.
Figure 2:
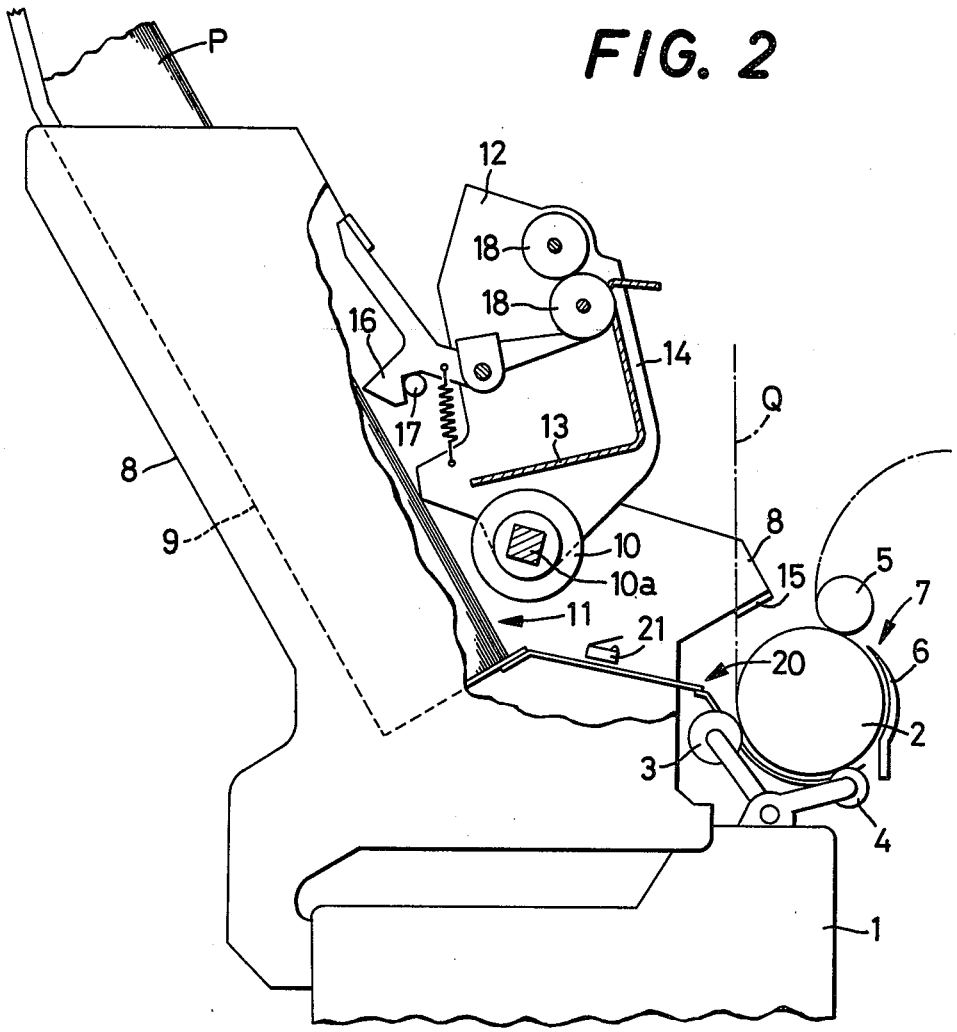
FIG. 2 is a view similar to FIG. 1, showing the paper handling assembly placed in its second position wherein a sheet of paper of another kind can be loaded for an interruption printing on this another kind of paper sheet.

A preferred embodiment of the present invention will be described in detail with reference to the accompanying drawings. In FIGS. 1 and 2, there is shown a paper handling assembly of a printer whose frame 1 rotatably supports a platen 2 and three guide rollers 3, 4 and 5 adapted to be in rolling contact with the circumference of the platen 2, so that a sheet of paper fed from the rear side (from the left-hand side as seen in the figures) of the platen 2 is advanced along the circumference of the platen in a counterclockwise direction as viewed in FIG. 1. Spaced forwardly away from the platen 2 is disposed a printing assembly generally indicated at 7 which includes a type element (not shown) in the form of a type wheel or the like and further includes a card-holder 6. The type element is mounted on a carriage (not shown) which is movable reciprocatingly longitudinally of the platen 2.

On the printer frame 1, there are secured a pair of side frames 8 of planar configuration which extend in an obliquely upward and rearward direction from the rear portions of the printer frame 1 on both right and left sides thereof. Between these side frames 8 is supported a first paper stacker 9 in which sheets of paper P to be printed are stacked one on another. In front of the lower portion of the first paper stacker 9 and adjacent the top sheet of a paper stack stored in the stacker 9 is provided a drive shaft 10*a* extending between and supported by the side frames 8. The drive shaft 10*a* which carries feed rollers 10 is connected to the platen 2 via a transmission mechanism not shown, and rotated in synchronization with the platen 2. When a sheet of paper P is fed from the first paper stacker 9, a rear plate of the stacker 9 is moved toward the drive shaft 10*a* until the top sheet of the stored paper stack is brought into contact with the circumference of the feed rollers 10. The first paper stacker 9, drive shaft 10*a*, feed rollers 10, etc. constitute a paper feeding device 11 for the sheet of paper P, wherein the individual sheets of paper P stored in the stacker 9 are fed one after another along a first paper inlet path toward the printing assembly 7 through rotary movements of the feed rollers 10 in a counterclockwise direction as seen in FIGS. 1 and 2. The sheets of paper P are then advanced to the printing start position through rotary movement of the platen 2 and desired printing operations are effected on those sheets of paper P.

On the right and left end portions of the drive shaft 10*a*, there are pivotally supported a pair of bracket plates 12, respectively, which bracket plates 12 carry a support member 13 secured thereto and extending therebetween. These plates 12 and the support member 13 cooperate to constitute a second paper stacker 14. The bracket plates 12 or the second paper stacker 14 is pivoted about the drive shaft 10*a* between its first or operative position of FIG. 1 at which the plates 12 are maintained by stopper portions 15 of the side frames 8 bent to extend from their front ends so as to abut on the bottom surfaces of the plates 12, and its second or inoperative position of FIG. 2 at which the plates 12 are locked by lock means consisting of a hook 16 connected to the inner surface of one of the plates 12, and an engagement pin 17 extending from the inner surface of the corresponding one of the side frames 8. Upwardly adjacent the guide roller 5 are provided a pair of paper ejection rollers 18 which are rotatably supported by the bracket plates 12 and rotated synchronously with the platen 2. When the second paper stacker 14 is placed in its first, operative position, the rotating ejection rollers 18 upwardly draw the printed sheet of paper P from the platen 2, thereby ejecting the printed sheet P into the second paper stacker 14 with the lower edge of the sheet abutting on the bottom portion of the support member 13. The second paper stacker 14 has a paper receiver frame 19 removably mounted thereon. This receiver frame 19 is removed from the stacker 14 when the latter is pivoted to its second, inoperative position.

When the second paper stacker 14 is pivoted to its second position of FIG. 2, an open space is provided above and at the rear of the platen 2, which space provides a second paper inlet path along which a sheet of paper Q different in size or format from the sheet of paper P can be directed to the platen 2 as illustrated in FIG. 2. The sheet of paper Q which has been directed to the platen 2 along the second inlet path is advanced by and between the guide rollers 3, 4, 5, and the platen 2. Thus, the rollers 3, 4 and 5 and the platen 2 cooperate to constitute a paper advancing device 20 for selectively advancing either the sheets of paper P or the sheet of paper Q. This device 20, and the paper feeding device 11 and the second paper stacker 14 constitute a paper handling assembly of the printer according to the invention.

On the inner surface of one of the side frames 8 is disposed a micro-switch 21 designed as detection means for sensing the currently selected position of the second paper stacker 14. The micro-switch 21 is positioned below the bracket plate 12 so that its actuator is in contact with the bottom surface of the plate 12 when the second paper stacker 14 is placed in its first position. In this position, the micro-switch 21 generates an electric detection signal representing that the second stacker 14 is placed in its first position and the paper feeding device 11 is consequently operative. It is noted here that the terms "first position" and "second position" referred to above are are equally applicable to the bracket plates 12 and to any other parts movable with the second paper stacker 14.

Figure 3:
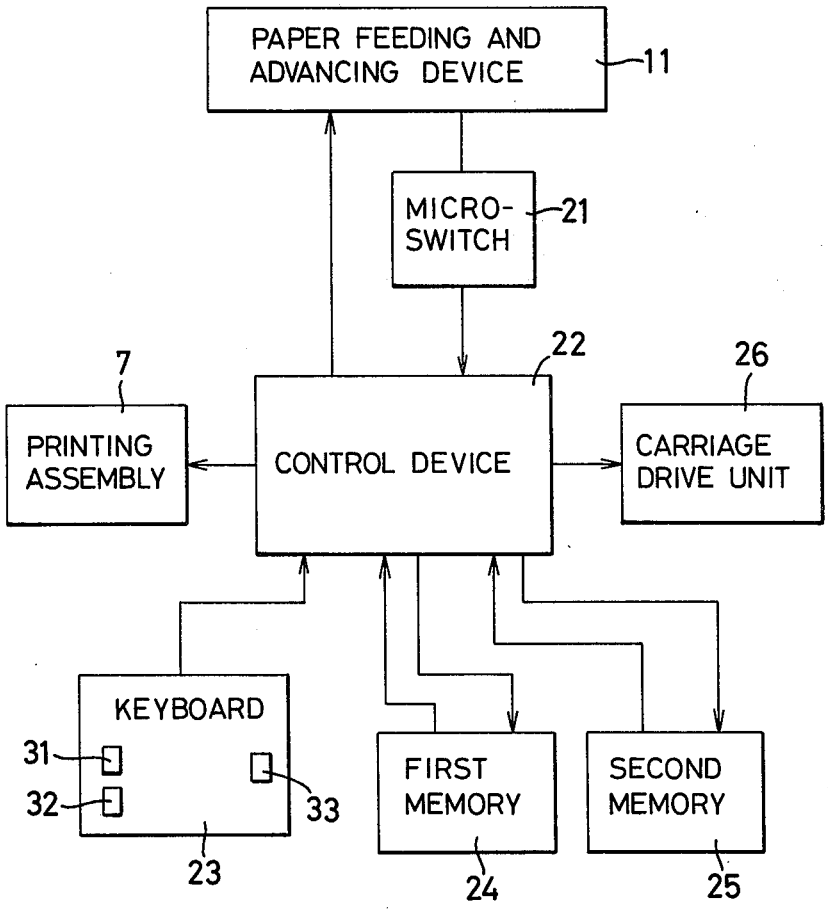
FIG. 3 is a schematic block diagram representing a control circuit for controlling the operation of the printing apparatus.

Referring next to FIG. 3, a control circuit for the printing apparatus of the present invention will be described below. A control device 22 receives predetermined control signals generated by a keyboard 23 through activation of various input keys arranged on the keyboard, and provides output signals to operate and control the previously described printing assembly 7 and paper feeding device 11. The control device 22 also functions to select a first memory 24 or a second memory 25 or selectively render these memories effective according to whether the detection signal from the micro-switch 21 is present or not. In this specific embodiment, the control device 22 is adapted such that the first memory 24 is selected or made effective when the detection signal from the micro-switch 21 is present and such that the second memory 25 is selected when the detection signal is absent.

The first memory 24 which is a read/write memory wherein stored information can be read out or new information written in at any storage location, is used to store information on left and right margin settings and tabulation settings and other data associated with sheets of paper P. The second memory 25 which is also a read/write memory is used to store information relating to such settings or other data associated with sheets of paper Q which are different in size and/or format from the sheets P. The control device 22 generates control signals to control a carriage drive unit 26 according to the information read out from the first or second memory 24, 25 selected by the detection signal from the micro-switch 21, whereby a carriage drive motor (not shown) is controlled as required.

When it is desired to achieve an ordinary printing operation on a sheet or sheets of paper P on the printing apparatus constructed as described hereinbefore, the second paper stacker 14 is first set in its first operative position as indicated in FIG. 1. In this first position, the micro-switch detector 21 is activated with its actuator kept in contact with the bottom of the stacker 14, and as a result, the first memory 24 for the sheets of paper P is selected. In this condition, appropriate information or data representing desired left/right margin and tabulation positions on the sheet P are stored into the selected first memory 24 by manipulating MARGIN and TAB SETTING keys 31 and 32 provided on the keyboard 23 while the type element of the printing assembly 7 is located at desired margin and tab positions. Depressing a PAPER INSERT switch 33 on the keyboard 23 will cause the paper feeding device 11 to be started to initiate an action of feeding a sheet of paper P toward the printing assembly 7. The sheet of paper P which has been delivered from the first paper stacker 9 is then advanced to the printing start position through rotary movements of the platen 2 with the aid of the guide rollers 3, 4, 5. During a printing operation on the sheet of paper P, the control device 22 reads out the stored margin and tabulation information from the first memory 24 to control the carriage drive unit 26 so that the printing assembly 7 will operate to effect printing between the right and left margin positions specified by such read-out information and according to the tabulation positions also specified by those information.

When it is required to effect printing on a sheet of paper Q during temporary interruption of a printing operation on successive sheets of paper P for example, the second paper stacker 14 is upwardly pivoted to its second inoperative position as shown in FIG. 2. In this second position, a paper inlet path leading to the platen 2 is formed adjacent the pivoted stacker 14 whereby the sheet of paper Q can be directed from above the platen 2 down to the rear portion of the platen 2 along the obtained paper inlet path. When the second paper stacker 14 is pivoted to the second position, the micro-switch 21 is freed from depression of the bottom surface of the stacker 14 and its detection signal becomes absent. Consequently, the control device 22 will cause the paper feeding device 11 to be held in its inoperative position and select the second memory 25 as an effective memory. In this condition, appropriate information on the right/left margin and tabulation positions for the sheet of paper Q are stored into the second memory 25 by manipulating the previously indicated SETTING keys 31 and 32, and the carriage drive unit 26 is operated according to the information read out from the second memory 25.

To resume the ordinary printing operation on the sheets of paper P after completion of the interruption printing on the sheet Q, the second paper stacker 14 is pivotally returned to its first operative position. This pivotal movement of the stacker 14 will re-activate the micro-switch 21 which then generates its detection signal selecting the first memory 24 whose information are used in the ordinary printing operation on the sheets P for specifying their margin and tabulation positions.

In the printing apparatus constructed as stated above, a changeover from an ordinary printing mode using paper sheets stored in the first stacker to an interruption print mode using a sheet of different size or format, or vice versa, can be readily made by simply pivoting the second paper stacker 14 between its first and second positions. This easy and fast changeover of a printing mode contributes to a significant improvement in operating efficiency of a printer capable of performing an interruption printing as described. A further advantage of the present printing apparatus lies in the flexibility or versatility of the two read/write memories 24, 25 the storage data of which may be changed as needed to meet specific requirements for settings of the right and left margin and tabulation positions for two different kinds of paper sheets.

While the present invention has been described in its preferred embodiment, it is to be understood that the invention is not limited thereto. It is possible, for example, that two paper storage/feeder units be provided one for each of two kinds of paper different in size and/or format from each other, and that two data memories be assigned to the respective kinds of paper sheets selectively delivered by the respective units so that a printing operation may be achieved on either kind of paper sheets according to the corresponding data selectively read out from the two memories. In this instance, a further improvement in efficiency of two-mode printing operation is expected on a printer having a paper feeding device. Other modifications, changes and variations of the details of construction and arrangement of parts of the present printing apparatus may be made without departing the spirit or scope of the following claims.

What is claimed is:

1. A printing apparatus having a printing assembly, and a paper handling assembly including a paper feeding device having a paper stacker and feeding individual sheets of paper of one kind one after another from the paper stacker along a first path, and further including a paper advancing device selectively advancing to the printing assembly either the sheets of paper of said one kind fed along the first path, or sheets of paper of another kind fed along a second path when the paper feeding device is inoperative, said printing apparatus comprising:

a first read/write memory for storing a first set of information associated with the sheets of paper of said one kind;

a second read/write memory for storing a second set of information associated with the sheets of paper of said another kind;

detection means for detecting an operative or inoperative position of said paper feeding device, said detection means generating an electric detection signal representing the detected position of said paper feeding device; and a control device connected to said first read/write memory, said second read/write memory and said detection means and responsive to said detection signal, said control device selecting as an effective memory said first read/write memory when said paper feeding device is set in said operative position and said second read/write memory when said paper feeding device is set in said inoperative position.

2. A printing apparatus as recited in claim 1, wherein said detection means generates said detection signal when said paper feeding device is set in said operative position, said control device selecting said first read/-write memory when said detection signal is present, and selecting said second read/write memory when said detection signal is absent.

3. A printing apparatus as recited in claim 1, wherein said paper handling assembly further includes another paper stacker pivotable selectively between a first position thereof at which said another paper stacker is operative to receive the printed sheets of paper of said one kind, and a second position thereof at which the sheets of paper of said another kind can be advanced by said paper advancing device, said detection means detecting, to indirectly detect said operative position of said paper feeding device, the selected first or second position of said another paper stacker, and generating said detection signal representing the selected position of said another paper stacker.

4. A printing apparatus as recited in claim 3, wherein said detection means generates said detection signal when said another paper stacker is set in said first position, said control device selecting said first read/write memory when said detection signal is present, and selecting said second read/write memory when said detection signal is absent.

5. A printing apparatus as recited in claim 4, wherein said control device causes said paper feeding device to be held in said inoperative position when said detection signal is absent.

6. A printing apparatus as recited in claim 1, wherein said first and second sets of information stored in said respective first and second read/write memories includes data representing right and left margin positions of the sheets of paper of said respective one and another kinds.

7. A printing apparatus as recited in claim 1, wherein said first and second sets of information stored in said respective first and second read/write memories includes data representing tabulation positions of the sheets of paper of said respective one and another kinds.

8. A printing apparatus as recited in claim 1, wherein said first and second sets of information stored in said respective first and second read/write memories includes data representing right and left margin positions and tabulation positions of the sheets of paper of said respective one and another kinds.

9. A printing apparatus having a printing assembly, a first paper stacker for storing sheets of paper of one kind, a paper feeding device including a feed roller for feeding the individual sheets of paper of said one kind one after another from the first paper stacker along a first path, a second paper stacker for receiving the printed sheets of paper of said one kind, and a paper advancing device including a platen for selectively advancing to the printing assembly either the sheets of paper of said one kind fed along the first path, or sheets of paper of another kind fed along a second path when the paper feeding device is inoperative, said printing apparatus comprising:

a first read/write memory for storing a first set of information including data representing right and left margin positions and tabulation positions associated with the sheets of paper of said one kind;

a second read/write memory for storing a second set of information including data representing right and left margin positions and tabulation positions associated with the sheets of paper of said another kind;

detection means, located to be activated by said second paper stacker, for detecting an operative position of the second paper stacker which is pivotable to an inoperative position thereof at which the sheet of paper of said another kind can be advanced by said paper advancing device, said detection means generating an electric detection signal representing said operative position of said second paper stacker; and a control device connected to said first and second memories and said detection means, and responsive to said detection signal, said control device selecting as an effective memory said first read/write memory when said detection signal is present and said second read/write memory when said detection signal is absent, said control device causing said paper feeding device to be held in its inoperative position when said detection signal is absent.

* * * * *